US010233048B2

(12) United States Patent
Noso et al.

(10) Patent No.: US 10,233,048 B2
(45) Date of Patent: Mar. 19, 2019

(54) SHEET POST-PROCESSING APPARATUS HAVING A PADDLE BLADE

(71) Applicant: KYOCERA Document Solutions Inc., Osaka-shi (JP)

(72) Inventors: Terumitsu Noso, Osaka (JP); Yasunori Ueno, Osaka (JP); Rina Okada, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 15/960,979

(22) Filed: Apr. 24, 2018

(65) Prior Publication Data

US 2018/0312363 A1 Nov. 1, 2018

(30) Foreign Application Priority Data

Apr. 28, 2017 (JP) ..... 2017-089623

(51) Int. Cl.

| | |
|---|---|
| ***B65H 37/04*** | (2006.01) |
| ***B65H 43/00*** | (2006.01) |
| *B65H 31/26* | (2006.01) |
| *G03G 15/00* | (2006.01) |

(52) U.S. Cl.

CPC ..... *B65H 37/04* (2013.01); *B65H 43/00* (2013.01); *B65H 31/26* (2013.01); *B65H 2301/51611* (2013.01); *B65H 2408/121* (2013.01); *B65H 2801/27* (2013.01); *G03G 15/65* (2013.01)

(58) Field of Classification Search

CPC .. G03G 15/6529; B65H 39/105; B65H 37/04; B65H 43/00; B42C 1/12

See application file for complete search history.

(56) References Cited

U.S. PATENT DOCUMENTS

| | | | | |
|---|---|---|---|---|
| 4,900,006 A * | 2/1990 | Mandel | ..... | B65H 3/0638 271/120 |
| 6,116,594 A * | 9/2000 | Boost | ..... | B65H 31/36 271/236 |
| 7,419,150 B2 * | 9/2008 | Kushida | ..... | B42C 1/12 270/58.07 |

(Continued)

FOREIGN PATENT DOCUMENTS

| | | |
|---|---|---|
| JP | 8-91686 | 4/1996 |
| JP | 2007-76913 | 3/2007 |

*Primary Examiner* — Patrick H Mackey

(74) *Attorney, Agent, or Firm* — Gerald E. Hespos; Michael J. Porco; Matthew T. Hespos

(57) ABSTRACT

A post-processing apparatus includes a loading tray, a post-processing unit for performing predetermined post-processing on a sheet before ejecting the sheet onto the loading tray, and a drawing paddle for sending the sheet conveyed toward the loading tray in a direction opposite to the conveying direction to draw the sheet to a predetermined position on a processing tray. The drawing paddle includes a paddle rotation shaft disposed above the processing tray with a predetermined distance from the processing tray, and a paddle blade fixed to the paddle rotation shaft. The paddle blade is a laminated body including an elastic sheet to be in contact with the sheet to be post-processed and a reinforcing sheet reinforcing the elastic sheet. The elastic sheet has a first length longer than the predetermined distance and the reinforcing sheet has a second length shorter than the predetermined distance.

4 Claims, 9 Drawing Sheets

(56) References Cited

U.S. PATENT DOCUMENTS

| | | | | |
|---|---|---|---|---|
| 7,673,867 | B2 * | 3/2010 | Keny | B42C 1/12 270/58.07 |
| 2014/0226994 | A1 * | 8/2014 | Leemhuis | G03G 15/086 399/13 |
| 2017/0166413 | A1 * | 6/2017 | Taki | B65H 39/10 |
| 2018/0239292 | A1 * | 8/2018 | Ko | G03G 15/6529 |

* cited by examiner

SHEET POST-PROCESSING APPARATUS HAVING A PADDLE BLADE

INCORPORATION BY REFERENCE

The present application is based on Japanese Patent Application 2017-89623 filed on Apr. 28, 2017, and its content is incorporated herein with reference.

BACKGROUND

The present disclosure relates to a post-processing apparatus that performs predetermined post-processing on sheets with images formed by an image forming apparatus.

A post-processing apparatus is known that performs post-processing such as stapling on sheets with images before ejecting the sheets onto a loading tray. The post-processing apparatus includes a processing tray for receiving sheets to be post-processed, and performs predetermined post-processing on the sheets at a predetermined position on the processing tray. The sheets to be post-processed are placed at the predetermined position, where the rear ends, in a sheet conveying direction, of the sheets are in contact with a sheet aligning member for aligning the rear ends of the sheets.

The post-processing apparatus can include a paddle above the processing tray. The paddle surely draws the sheet, which has been conveyed toward the loading tray, into the predetermined position on the processing tray without delay. The paddle generally includes a paddle rotation shaft and a paddle blade to be in contact with a sheet. The paddle blade rotating around the paddle rotation shaft comes into contact with a sheet and sends the sheet to the predetermined position on the processing tray.

SUMMARY

The post-processing apparatus according to one aspect of the present disclosure includes a loading tray, a post-processing unit, and a paddle unit. The loading tray receives sheets that have been conveyed from a predetermined conveying direction. The post-processing unit includes a processing tray for receiving sheets to be post-processed, the processing tray being disposed upstream of the loading tray in the conveying direction, and a post-processing device for performing predetermined post-processing on the sheets at a predetermined position on the processing tray, the post-processing unit ejecting the post-processed sheets onto the loading tray. The drawing paddle sends a sheet conveyed toward the loading tray in a direction opposite to the conveying direction to draw the sheet into the predetermined position on the processing tray.

The drawing paddle includes a paddle rotation shaft disposed above the processing tray with a predetermined distance from the processing tray, and a paddle blade fixed to the paddle rotation shaft. The sheet coming into contact with the paddle blade is drawn by the rotation of the paddle rotation shaft. The paddle blade is a laminated body including an elastic sheet having a high friction surface and configured to be in contact with a sheet to be post-processed, and a reinforcing sheet reinforcing the elastic sheet. In a direction orthogonal to the paddle rotation shaft, the elastic sheet has a first length longer than the predetermined distance and the reinforcing sheet has a second length shorter than the predetermined distance.

DETAILED DESCRIPTION

Figure 1:
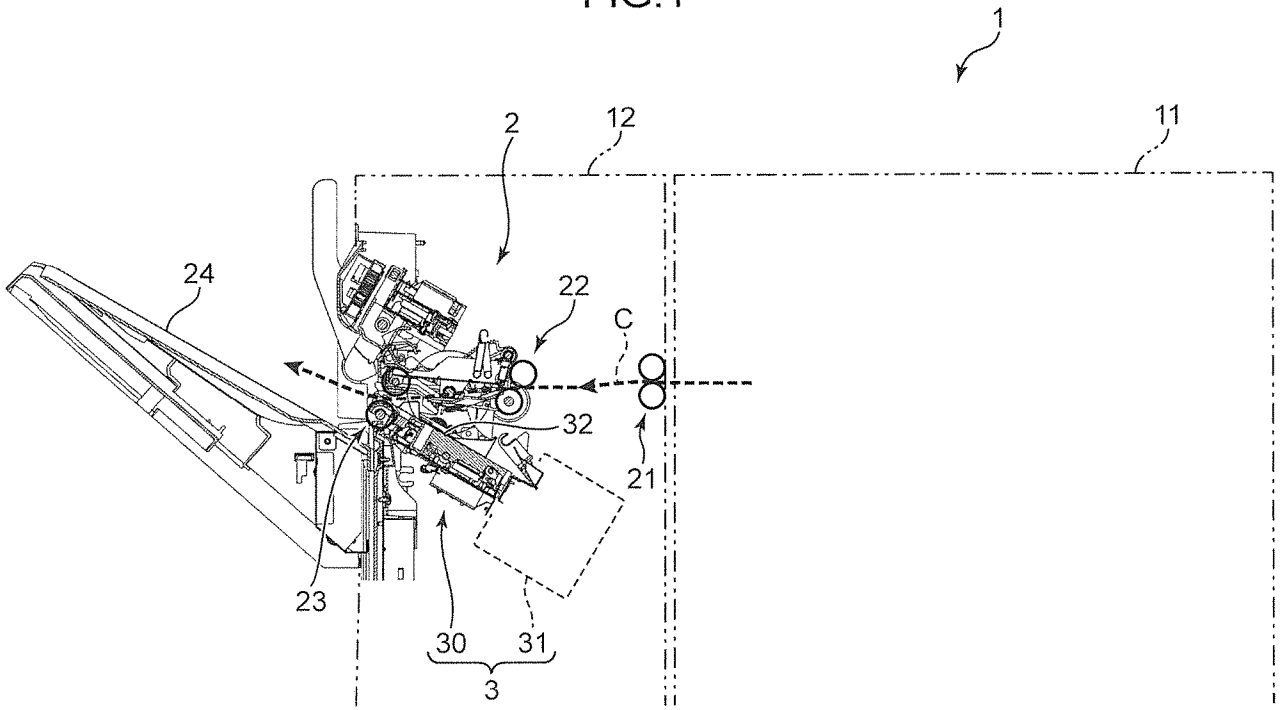
FIG. 1 is a schematic view of an image forming apparatus including a post-processing apparatus according to one embodiment of the present disclosure.

With reference to the accompanying drawings, an embodiment of the present disclosure will now be described in detail. FIG. 1 is a schematic view of an image forming apparatus 1 including a post-processing apparatus 2 according to one embodiment of the present disclosure. The image forming apparatus 1 includes a main housing 11 for housing an image forming apparatus main body for forming an image on a sheet, and a post-processing housing 12 for housing the post-processing apparatus 2 for performing predetermined post-processing on the sheet after the image forming process.

The main housing 11 houses equipment for forming an image by electrophotography or by ink-jet printing, for example. In the case of electrophotography, the main housing 11 houses equipment such as an image forming unit including a photoconductor drum, an electrifying device, a developing device, and an exposing device; a fixing unit; and a toner container. In the case of ink-jet printing, the main housing 11 houses equipment such as a printing unit including an ink-jet head, a drying unit, and an ink tank.

[General Structure of Post-Processing Apparatus]

The post-processing apparatus 2 in the post-processing housing 12 performs predetermined post-processing on a sheet or a bundle of sheets that has undergone the image forming process in the main housing 11. Examples of the post-processing include a punch process to punch sheets for binding, a stapling process for stapling the bundle of sheets, a folding process for folding sheets in the middle, aligning process including an operation of aligning sheets in the width direction and a shift operation for shifting an ejection position of sheets by a predetermined number of the sheets. FIG. 1 shows a post-processing unit 3 including a sheet aligning unit 30 (post-processing device) for performing the above aligning process and a stapler 31 (post-processing device) for performing the above stapling process, omitting a punching device for performing the above punching process and a folding device for performing the above folding process.

The post-processing apparatus 2 includes a sheet conveying path C. The sheet conveying path C conveys a sheet, which has been sent from the main housing 11 into the post-processing housing 12, in a predetermined conveying direction, via the post-processing unit 3. The post-processing apparatus 2 also includes a loading tray 24 for receiving a sheet that has gone through the post-processing housing 12 with or without post-processing. On the sheet conveying path C, there are disposed a take-in roller pair 21, a first take-out roller pair 22, and a second take-out roller pair 23 in this order from the upstream of the sheet conveying direction.

The take-in roller pair 21 is a sheet conveying roller pair disposed near a wall of the post-processing housing 12, the wall being next to the main housing 11, and takes a sheet with an image into the post-processing housing 12. The first take-out roller pair 22 is a sheet conveying roller pair disposed upstream of the post-processing unit 3, and sends the sheet into the post-processing unit 3. The second take-out roller pair 23 is a sheet conveying roller pair disposed downstream of the post-processing unit 3, that is, on the sheet conveying path C, and ejects the sheet onto the loading tray 24. The loading tray 24 moves up and down and receives the sheet that has been conveyed along the conveying path C.

Figure 2:
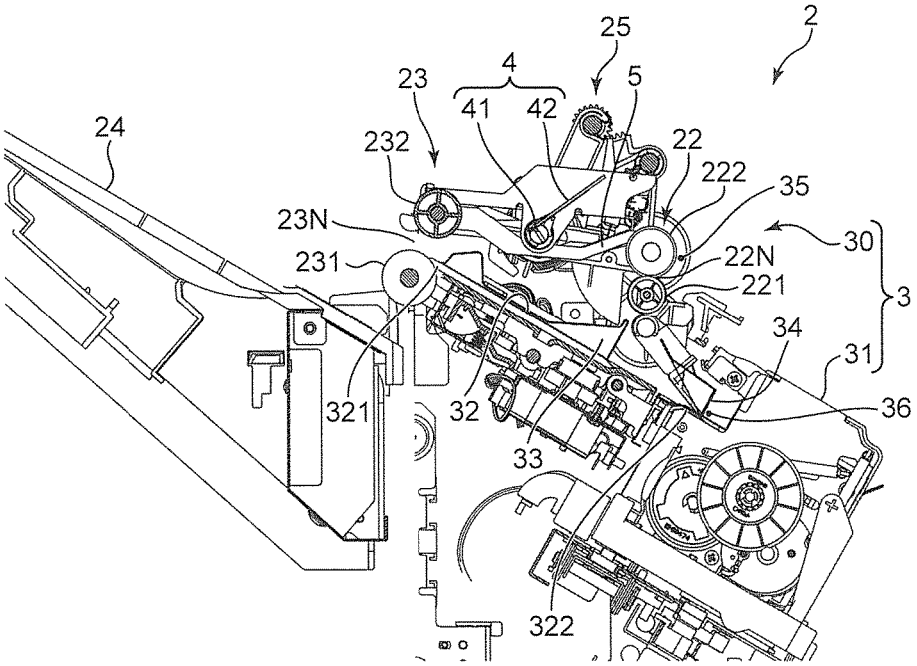
FIG. 2 is a cross-sectional side view of an essential part of the post-processing apparatus.
Figure 3:
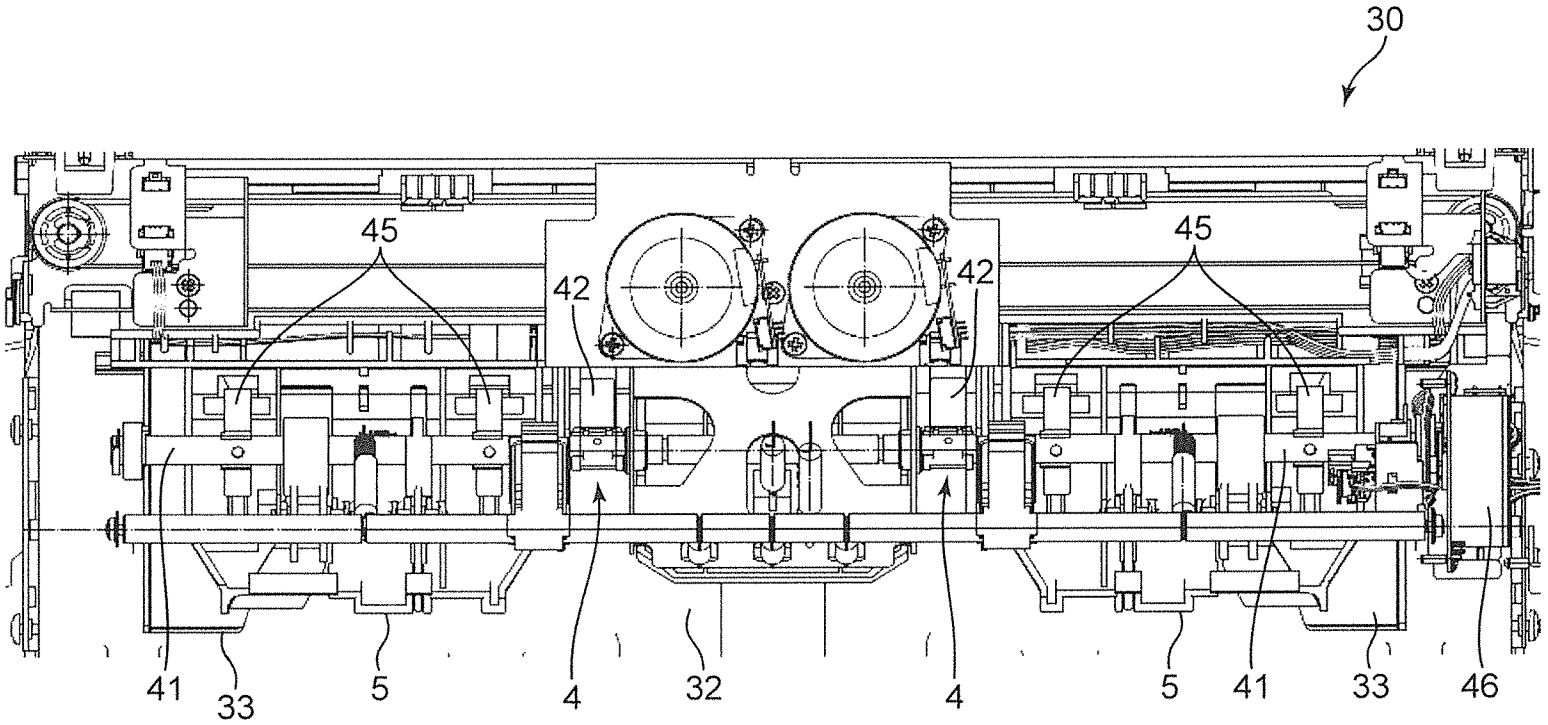
FIG. 3 is a top plane view of a sheet aligning unit of the post-processing apparatus.

With reference to FIGS. 2 and 3, the structure of the post-processing unit 3 will now be described in detail. FIG. 2 is a cross-sectional side view of the post-processing unit 3, and FIG. 3 is a top plane view of the sheet aligning unit 30. The first take-out roller pair 22 includes a driving roller 222 to be driven by a conveyance driving motor 26 (shown in FIG. 8), and a driven roller 221 that rotates following the rotation of the driving roller 222. The surfaces of the driving roller 222 and the driven roller 221 are pressed against each other with a predetermined nip pressure and make a first nip area 22N where a sheet is pressed while being conveyed.

The second take-out roller pair 23 includes a driving roller 231 to be driven by the conveyance driving motor 26 (shown in FIG. 8) and a driven roller 232 that rotates following the rotation of the driving roller 231. The surfaces of the driving roller 231 and the driven roller 232 are pressed against each other with a predetermined nip pressure and make a second nip area 23N where a sheet is pressed while being conveyed. The second nip area 23N is released while sheets are being aligned. The post-processing apparatus 2 includes a nip releasing mechanism 25 for releasing the second nip area 23N. The nip releasing mechanism 25 includes an arm for supporting the roller shaft of the driven roller 232, a gear mechanism for moving the arm up and down, and a driving source (a nip releasing actuator 251 in FIG. 8), and lifts the driven roller 232 to release the second nip area 23N. FIG. 2 shows the state in which the second nip area 23N is released.

The sheet aligning unit 30 includes the processing tray 32; a pair of width-direction aligning cursors 33 and a receiving member 34, the cursors 33 and the receiving member 34 being mounted on the processing tray 32; a paddle unit 4 (drawing paddle) disposed above the processing tray 32; and a push-down unit 5. The sheet aligning unit 30 includes a sheet detecting sensor 35 and a sheet-arrival detecting sensor 36.

The processing tray 32 is disposed upstream of the loading tray 24 in the sheet conveying direction, and receives a sheet to be post-processed. The processing tray 32 is slanted so that its downstream end 321 is at a higher level than its upstream end 322 in the sheet conveying direction. The downstream end 321 of the processing tray 32 is disposed near the second take-out roller pair 23, and the upstream end 322 is disposed downstream of the first take-out roller pair 22. After being post-processed on the processing tray 32, sheets go through the second nip area 23N restored by the second take-out roller pair 23 to be ejected onto the loading tray 24.

The pair of the width-direction aligning cursors 33 is disposed so that a sheet will be placed between the cursors 33 in the width direction on the processing tray 32 (see FIG. 3). The width-direction aligning cursors 33 come into contact with the longitudinal edges of the sheet to correct the skew of the sheet and align the sheet bundle properly in the width direction. The pair of the width-direction aligning cursors 33 move along a guiding part in the width direction on the processing tray 32 to come close to each other or come apart from each other in a synchronized manner.

The receiving member 34 is disposed at the upstream end 322 of the processing tray 32, that is, at the lowest position of the slanting processing tray 32. The receiving member 34 has a U-shaped cross-section. The receiving member 34 is open in U-shape toward the downstream end 321 of the processing tray 32, and receives a sheet sliding down the slanting surface of the processing tray 32 with its upstream end (rear end) in the sheet conveying direction. When some sheets are placed at the predetermined position on the processing tray 32 with their rear ends in contact with the bottom of the receiving member 34 and with their longitudinal edges held by the width-direction aligning cursors 33, those sheets are considered to be ready for stapling (predetermined post-processing) by the stapler 31.

The sheet detecting sensor 35 is disposed immediately upstream of the first take-out roller pair 22 and optically detects a sheet. The sheet detecting sensor 35 detects the passage of a sheet through the first nip area 22N on the sheet conveying path C, which means that the sheet is ready for falling onto the processing tray 32.

The sheet-arrival detecting sensor 36 is disposed near the receiving member 34 and optically detects a sheet. The sheet-arrival detecting sensor 36 detects the arrival of the rear end of a sheet at the bottom of the receiving member 34 on the processing tray 32, which means the sheet is placed at the predetermined position for stapling.

The paddle unit 4 sends a sheet to be received the processing tray 32 to the upstream end 322 so that the rear end of the sheet comes into contact with the receiving member 34 on the processing tray 32. Specifically, the paddle unit 4 sends a sheet, the sheet having been conveyed along the sheet conveying path C in the predetermined conveying direction, in a direction opposite to the conveying direction toward the loading tray 24 to draw the sheet into the predetermined position on the processing tray 32.

The paddle unit 4 includes a rotation shaft 41 (paddle rotation shaft) and a paddle blade 42 fixed to the rotation shaft 41. The rotation shaft 41 linearly extends in the width direction and is disposed above the processing tray 32 with a predetermined distance from the processing tray 32. The rotation shaft 41 is rotatably supported around the shaft, and is driven by a paddle driving motor 46 (driving source). The paddle blade 42 is made of a sheet member and rotates following the rotation of the rotation shaft 41. While rotating following the rotation of the rotation shaft 41, the tip part of the paddle blade 42 comes into contact with a sheet on the processing tray 32 and draws the sheet toward the upstream end 322 of the processing tray 32.

This embodiment includes two paddle blades 42. The two paddle blades 42 are fixed to the rotation shaft 41 generally in the middle in the axial direction such that the two paddle blades 42 are separated from each other. The paddle unit 4 having a plurality of paddle blades 42 on the rotation shaft 41 can draw a sheet more effectively. The paddle unit 4 having the paddle blades 42 on the rotation shaft 41 generally in the middle in the axial direction can surely apply a sufficient force to a sheet regardless of the width of the sheet.

The push-down unit 5 pushes down the rear end area of a sheet that has passed the first nip area 22N to make the sheet fall onto the processing tray 32. The push-down unit 5 is made of a generally rectangular plate in a top view. As shown in FIG. 3, this embodiment includes two push-down units 5. One of the push-down units 5 is disposed near one end of the paddle unit 4 and the other push-down unit 5 is disposed near the other end of the paddle unit 4 in the axial direction. Each push-down unit 5 is large enough to extend from the end of the rotation shaft 41 to a position where the paddle unit 4 is disposed, in the width direction.

The downstream area of each push-down unit 5 is disposed near the second take-out roller pair 23 and supported by a rocking shaft (not shown) extending in the width direction like the rotation shaft 41 in a cantilevered manner. Each push-down unit 5 can thus move up and down around the rocking shaft. The rocking movement of the push-down unit 5 is achieved by an eccentric cam 45 fixed to the rotation shaft 41. The rear side of the push-down unit 5 is pressed against the circumferential surface of the eccentric cam 45. While the eccentric cam 45 is rotating following the rotation of the rotation shaft 41, a large-diameter part and a small-diameter part of the eccentric cam 45 alternately come into contact with the push-down unit 5. During one rotation of the eccentric cam 45, the upstream end area of the push-down unit 5 makes one vertical movement.

The stapler 31 staples a sheet bundle consisting of a plurality of sheets. The stapling is performed in the corner of the sheet bundle or along edges of the sheet bundle for binding. The stapler 31 staples the sheets when the rear ends of the sheets are in contact with the receiving member 34 on the processing tray 32.

[Operation of Post-Processing Unit]

Figure 4:
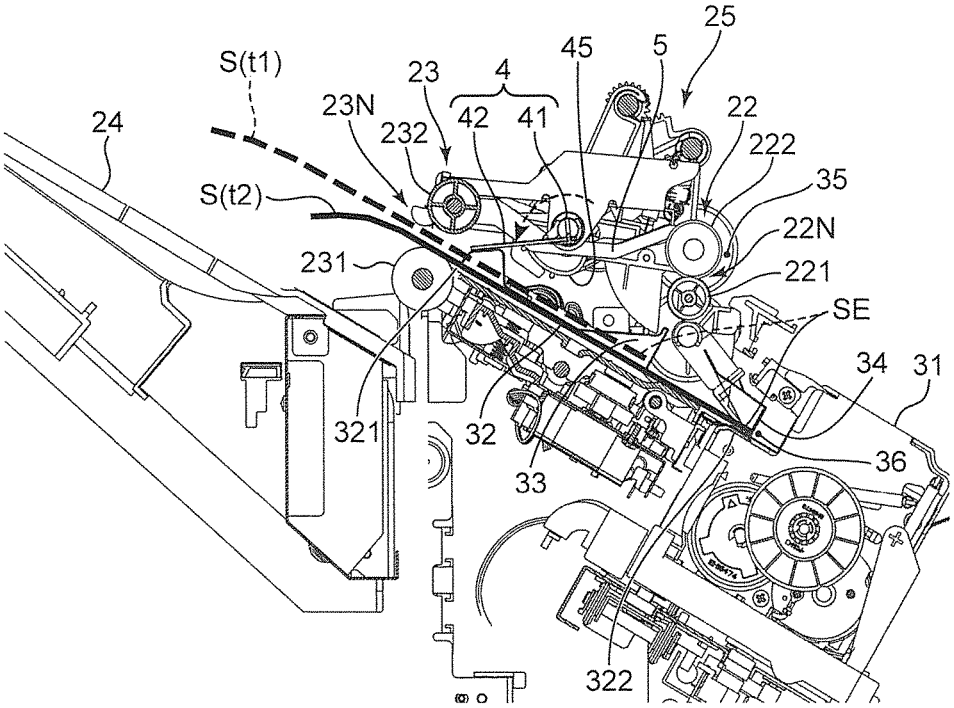
FIG. 4 is a side view showing the operation of a post-processing unit for drawing a sheet into a processing tray.

FIG. 4 is a side view especially showing the operation of the post-processing unit 3 for drawing a sheet into the processing tray 32. The take-in roller pair 21 takes a sheet S with an image from the main housing 11 into the post-processing housing 12 and sends the sheet S on the sheet conveying path C (see FIG. 1). The sheet S is conveyed by the first take-out roller pair 22 and the second take-out roller pair 23 toward the loading tray 24. If no post-processing is necessary for the sheet S, the sheet S is directly ejected onto the loading tray 24.

If the sheet S is the first sheet to be post-processed, the conveyance of the sheet S by the first and second take-out roller pairs 22 and 23 toward the loading tray 24 is carried out. When the sheet detecting sensor 35 switches from a detecting state to a non-detecting state, that is, the rear end SE of the sheet S passes the first nip area 22N made by the first take-out roller pair 22, the driving roller 231 of the second take-out roller pair 23 starts a reverse rotation and the push-down units 5 start their operation. The push-down units 5 push down the sheet S onto the processing tray 32 and the second take-out roller pair 23 draws the sheet S into the processing tray 32. When the rear end SE of the sheet S arrives at the receiving member 34, the nip releasing mechanism 25 lifts the driven roller 232 to release the second nip area 23N.

The nip releasing mechanism 25 leaves the second nip area 23 N released so that the second nip area 23N is released when the second and subsequent sheets S come. When the rear end SE of the sheet S passes the first nip area 22N made by the first take-out roller pair 22, the paddle driving motor 46 rotates the rotation shaft 41 to rotate the eccentric cam 45, which causes the push-down units 5 to push down the rear end SE of the sheet S. This makes the sheet S fall onto the processing tray 32 as shown in the broken line in FIG. 4. The sheet S at this position is shown as a sheet S(t1). At the sheet S(t1), the rear end SE is, however, still away from the position (predetermined position) of the receiving member 34.

The pair of the width-direction aligning cursors 33 is then operated to come into contact with the longitudinal edges of the sheet S(t1) for correcting the skew of the sheet S(t1). After that, the width-direction aligning cursors 33 go back to the original positions, and the paddle unit 4 starts to draw the sheet S(t1). Specifically, the rotation shaft 41 starts to rotate, which causes the paddle blades 42 to rotate around the rotation shaft 41 (in the counterclockwise direction in FIG. 4). The rotating paddle blades 42 come into contact with the sheet S(t1) and send the sheet S(t1) in the direction opposite to the sheet conveying direction. The rotation of the rotation shaft 41 also rotates the eccentric cam 45, which causes the push-down units 5 to move up and down. The rocking movement of the push-down units 5 corrects the curl of the sheet S(t1). The width-direction alignment cursors 33 may not be operated during the drawing operation, depending on the size of the sheet S.

The operation of the paddle unit 4 makes the sheet S(t1) move until the rear end SE of the sheet S comes into contact with the receiving member 34 as shown in the solid line in FIG. 4. The sheet S at this position is shown as a sheet S(t2). The sheet S(t2) is ready for stapling by the stapler 31. The paddle blades 42 continue to rotate for a predetermined length of time depending on the size of the sheet S or until the sheet-arrival detecting sensor 36 detects the arrival of the rear end SE at a position of the receiving member 34. The pair of the width-direction aligning cursors 33 is then operated again to align the sheet S(t2) properly in the width direction.

As for the second and subsequent sheets S, the same procedure takes place. If ten sheets P are to be stapled, for example, the second to tenth sheets S are subject to the above push-down operation, push-in operation, and aligning operation in this order as in the first sheet S. During the procedure, the second nip area 23N remains released. After the predetermined number of sheets P have been stacked, the stapler 31 staples the bundle of the sheets P. After that, the second nip area 23N is restored, and the driving roller 231 is driven to eject the stapled the bundle of the sheets P onto the loading tray 24.

[Detailed Structure of Paddle Blades]

As described above, after the sheet S has fallen onto the processing tray 32, the drawing operation in which the paddle unit 4 draws the sheet S into the receiving member 34 on the processing tray 32 is carried out. A conventional paddle unit, however, may fail to draw the sheet S properly depending on a surface state of a sheet S.

In the case of a sheet S with an image formed by ink-jet printing in the main housing 11, for example, the sheet S is likely to have a high moisture content, which increases the surface friction of the sheet S. In this case, a conventional paddle unit cannot draw the position of the sheet S properly, resulting in a misalignment of the sheet S on the processing tray 32. In view of this disadvantage, the paddle unit 4 of the present embodiment includes the paddle blades 42 that can send a sheet S with a greater force. The structure of the paddle blades 42 will now be described in detail.

Figure 5:
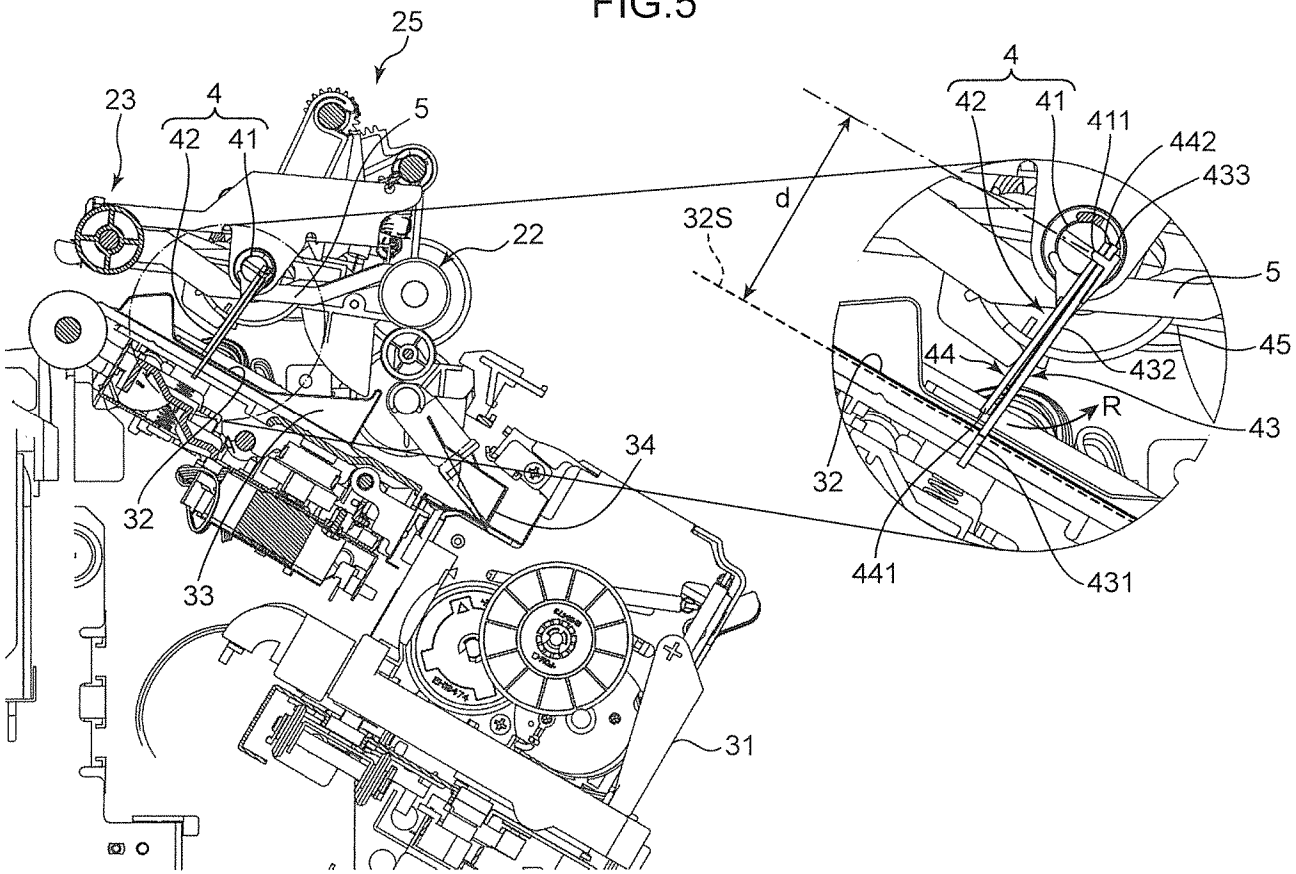
FIG. 5 is a cross-sectional view of an essential part of the sheet aligning unit with an enlarged view of a paddle unit.

FIG. 5 is a cross-sectional view of the sheet aligning unit 30 with an enlarged view of the paddle unit 4. Each paddle blade 42 of the paddle unit 4 is a laminated body including an elastic sheet 43 and a reinforcing sheet 44. The laminated body has the elastic sheet 43 on the downstream side and the reinforcing sheet 44 on the upstream side in the rotation direction of the rotation shaft 41 (the direction shown in the arrow R in FIG. 5).

The elastic sheet 43 has a high-friction surface and is configured to be in contact with a sheet S. The elastic sheet 43 may be a flexible rubber sheet having a thickness in the range of approximately 1 mm to 3 mm and composed of EPDM, nitrile rubber, or silicon rubber, for example. The rubber sheet selected for the elastic sheet 43 should preferably have flexibility to bend in the rotation direction of the rotation shaft 41 as well as a high friction with a sheet S while rotating around the rotation shaft 41 in contact with the sheet S. Such a rubber sheet may make up the entire part of the elastic sheet 43 or only an area to be in contact with a sheet S. In the latter case, the elastic sheet 43 may have the rubber sheet attached to the tip end of the base material such as a resin sheet or a resin film.

The reinforcing sheet 44 reinforces the elastic sheet 43. The reinforcing sheet 44 may be composed of a polyester sheet such as Lumirror (Registered trademark), a resin sheet such as a fluoro-resin sheet, a metal sheet, or a laminated sheet of a metal sheet and a resin sheet. The reinforcing sheet 44 gives a certain degree of strength to the paddle blade 42, otherwise the paddle blade 42 only with the elastic sheet 43 would be too flexible. The reinforcing sheet 44, however, should not be too rigid. The sheet selected for the reinforcing sheet 44 should preferably have a certain degree of flexibility so that the reinforcing sheet 44 can conform to the curve of the elastic sheet 43 when the elastic sheet 43 bends in contact with a sheet S.

The elastic sheet 43 includes a tip part (first part) 431, an intermediate part (second part) 432, and a base part 433. The tip part 431 is configured to be in contact with a sheet S. The intermediate part 432 and the base part 433 are laminated with the reinforcing sheet 44. The reinforcing sheet 44 includes a tip part 441 and a base part 442. The base part 433 of the elastic sheet 43 and the base part 442 of the reinforcing sheet 44 are laminated with each other in the thickness direction of the sheets and fastened to each other by a fastener 411 mounted on the rotation shaft 41. The intermediate part 432 of the elastic sheet 43 is not fastened to the reinforcing sheet 44 so that the elastic sheet 43 can be separated from the reinforcing sheet 44 in the intermediate part 432.

The lengths of elastic sheet 43 and the reinforcing sheet 44 in the direction orthogonal to the rotation shaft 41 will be described. The rotation shaft 41 is disposed above the processing tray 32 with a predetermined distance d from a surface 32S of the processing tray 32. The elastic sheet 43 has a first length longer than the distance d and the reinforcing sheet 44 has a second length shorter than the distance d. The distance d is the shortest distance between the center of the rotation shaft 41 and the tray surface 32S. The fastener 411 is disposed at the center of the rotation shaft 41. When the elastic sheet 43 is in a straight state with no deformation, the length from the fastener 411 to the tip end of the tip part 431 is longer than the distance d. When the reinforcing sheet 44 is in a straight state with no deformation, the length from the fastener 411 to the tip end of the tip part 441 is shorter than the distance d.

Under these circumstances, when the paddle blade 42 rotates around the rotation shaft 41, the elastic sheet 43 with the first length comes into contact with a sheet S on the tray surface 32S but the reinforcing sheet 44 with the second length does not come into contact with the sheet S. The tip part 431, which is free from the restriction by the reinforcing sheet 44, of the elastic sheet 43 substantially bends while being in contact with the sheet S in a large area. The intermediate part 432, which is reinforced by the reinforcing sheet 44, of the elastic sheet 43 ensures the strength necessary for working as the paddle blade 42. These characteristics enable the paddle blade 42 to draw the sheet S more effectively.

Figure 6:
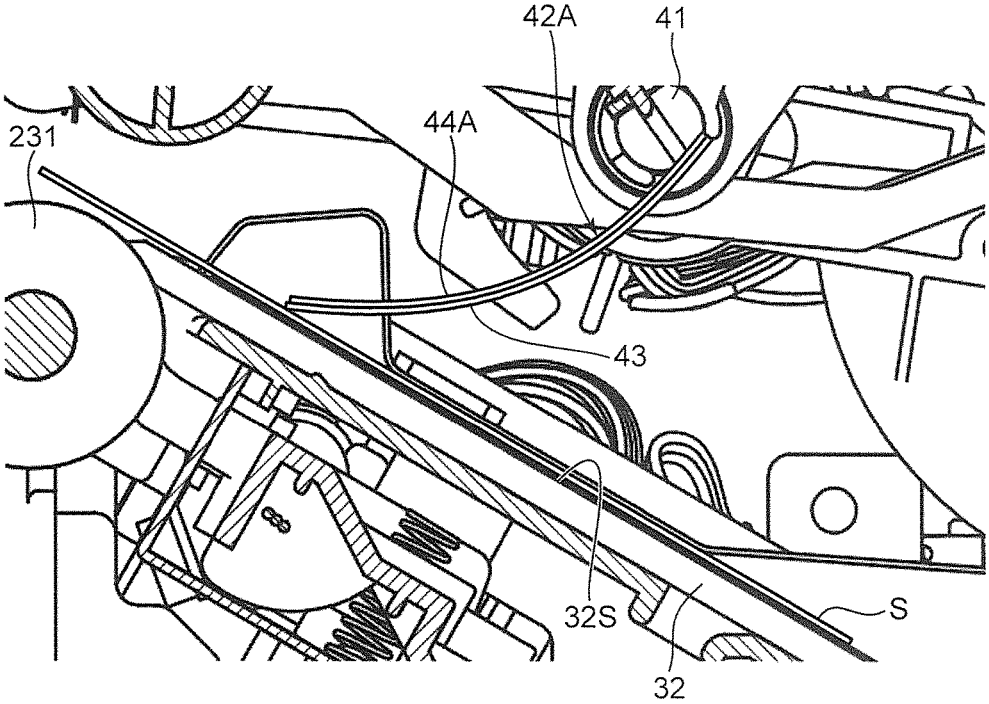
FIG. 6 is a view showing the operation of a conventional paddle unit for drawing operation of a sheet.

This will further be described by comparing the paddle blade 42 with a conventional paddle blade 42A. FIG. 6 is a view showing the operation of the conventional paddle blade 42A for drawing a sheet S. The paddle blade 42A includes the elastic sheet 43 and a reinforcing sheet 44A. The reinforcing sheet 44A is as long as the elastic sheet 43 in the direction orthogonal to the rotation shaft 41. The reinforcing sheet 44A thus has the first length longer than the distance d. FIG. 6 shows the paddle blade 42A rotating counterclockwise around the rotation shaft 41.

The rear side of the elastic sheet 43 in the rotation direction is supported by the reinforcing sheet 44A all the length, so that the degree of bending of the elastic sheet 43 depends on the flexibility of the reinforcing sheet 44A. In this case, the elastic sheet 43 cannot substantially bend along the surface of the sheet S and the tip part of the elastic sheet 43 can be in contact with the sheet S only in a small area. If the sheet S has a high moisture content and a high-friction surface, the paddle blade 42A may fail to apply a sufficient force to the sheet S against the friction between the sheet S and the tray surface 32S. In this case, the paddle blade 42 may fail to draw the sheet S into the receiving member 34 properly.

Figure 7:
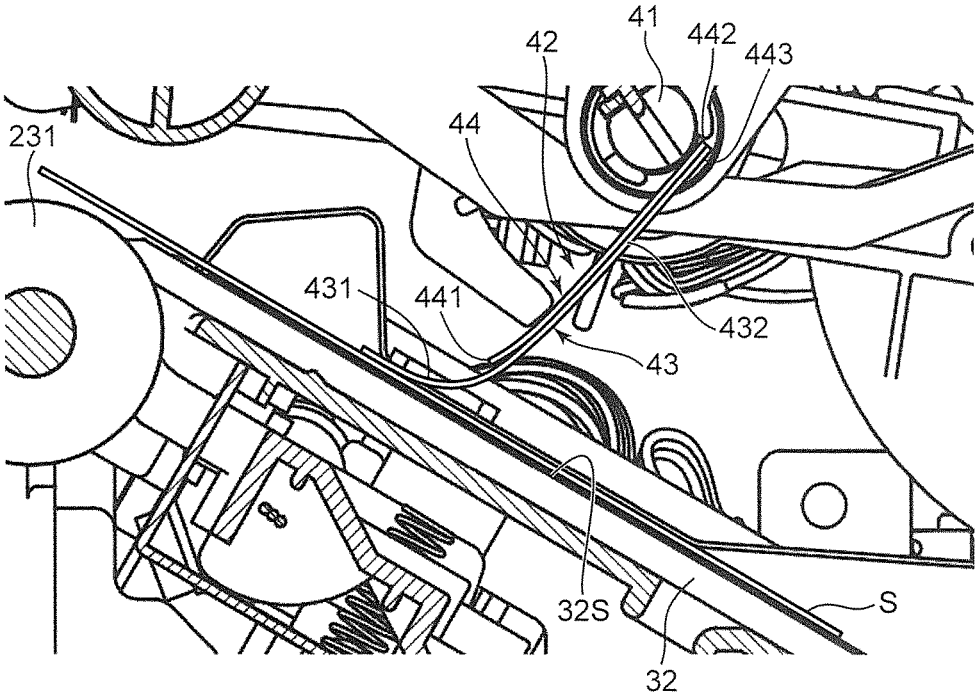
FIG. 7 is a view showing the operation of the paddle unit of the present embodiment for drawing operation of a sheet.

FIG. 7 is a view showing the operation of the paddle blade 42 of the present embodiment for pushing a sheet S. According to the present embodiment, only the tip part 431 of the elastic sheet 43 comes into contact with the sheet S when the paddle blade 42 rotates counterclockwise around the rotation shaft 41. The tip part 441 of the reinforcing sheet 44 is above the tray surface 32S without contact. Since the rear side of the tip part 431 in the rotation direction is free from the support by the reinforcing sheet 44, the elastic sheet 43 can fully exert its elasticity to substantially bend in the tip part 431.

As shown in FIG. 7, the tip part 431 can substantially bend along the surface of the sheet S while being in contact with the sheet S in a large area. Even if the sheet S has a high moisture content, the paddle blade 42 can apply a sufficient force to the sheet S against the friction between the sheet S and the tray surface 32S and draw the sheet S to the predetermined position for sure.

The reinforcing sheet 44 has a certain degree of flexibility to allow the intermediate part 432 to bend following the bending of the tip part 431. If the reinforcing sheet 44 does not have flexibility allowing the bending of the intermediate part 432, the paddle blade 42 will press the sheet S against the processing tray 32 with a greater force, which may lead to a failure of the paddle blade 42 in drawing the sheet S properly. The reinforcing sheet 44 with a proper flexibility contributes to draw the sheet S properly without pressing the sheet S against the processing tray 32 too much.

[Electrical Structure of Post-Processing Apparatus]

Figure 8:
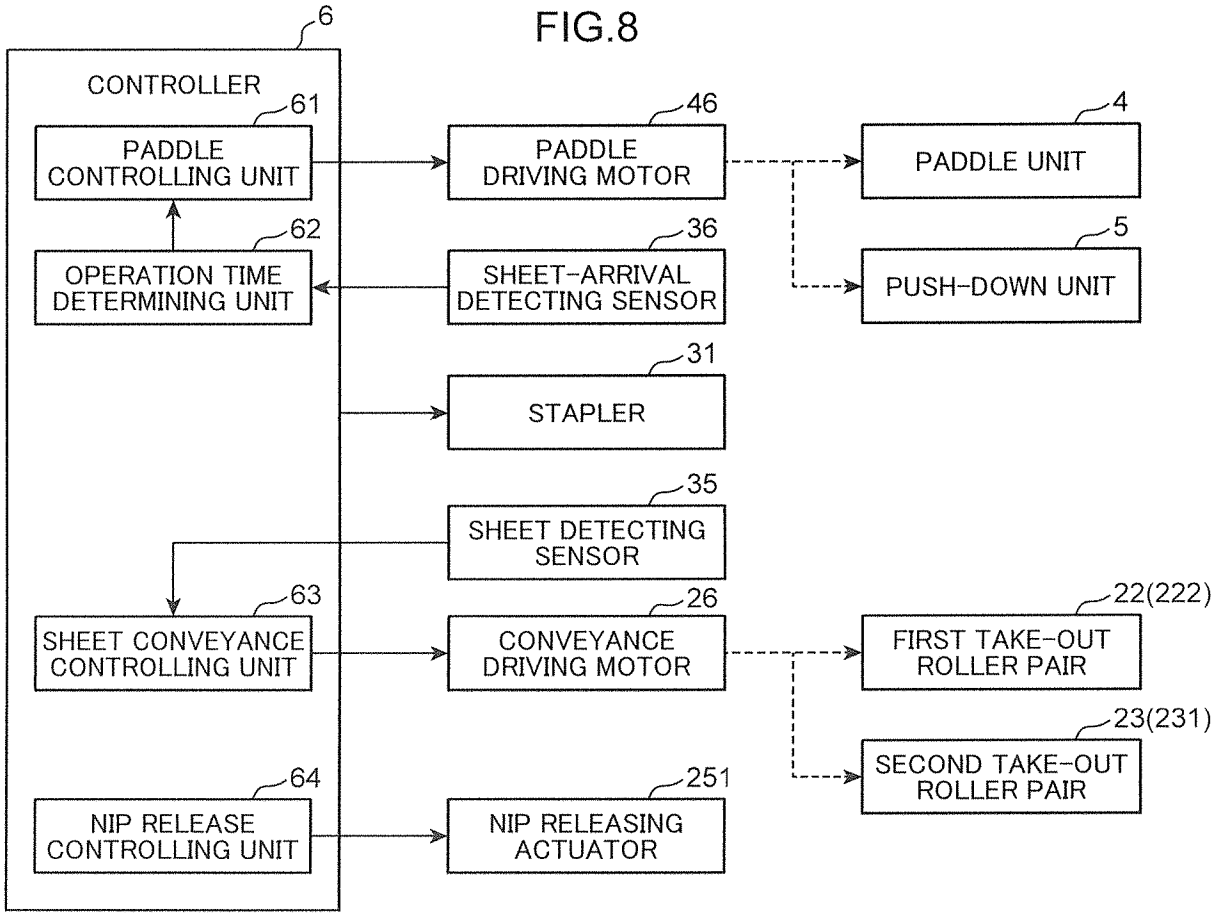
FIG. 8 is a block diagram showing the electrical structure of the post-processing apparatus.

FIG. 8 is a block diagram showing the electrical structure of the post-processing apparatus 2. The post-processing apparatus 2 includes the paddle driving motor 46, the sheet-arrival detecting sensor 36, the stapler 31, and the sheet detecting sensor 35, all of which have been described above. The post-processing apparatus 2 also includes the conveyance driving motor 26, the nip releasing actuator 251, and a controller 6. The structural elements described above will not be explained here.

The conveyance driving motor 26 is a driving source which rotates and drives the driving roller 222 of the first take-out roller pair 22 and the driving roller 231 of the second take-out roller pair 23. The nip releasing actuator 251 is a driving source of the nip releasing mechanism 25, that is, a driving source which drives to release or restore the second nip area 23N.

The controller 6 includes a central processing unit (CPU) for controlling individual parts of the post-processing apparatus 2, a read only memory (ROM) for storing control programs, and a random access memory (RAM) for providing a working area for the CPU. In the controller 6, the CPU exerts the control programs stored in the ROM to function as a paddle controlling unit 61, an operation time determining unit 62, a conveyance controlling unit 63, and a nip release controlling unit 64.

The paddle controlling unit 61 controls the paddle driving motor 46 for rotating the rotation shaft 41 to control the rotation of the paddle unit 4 (the paddle blades 42) and the push-down of the push-down units 5.

The operation time determining unit 62 determines an operation time of the paddle unit 4 for drawing the sheet S into the predetermined position (into the receiving member 34) on the processing tray 32, that is, a rotation time of the rotation shaft 41 to be driven by the paddle driving motor 46. When determining the operation or rotation time, the operation time determining unit 62 refers to the data on characteristics of a sheet S to be post-processed. The paddle driving motor 46 rotates the rotation shaft 41 at a constant rotation rate. A longer operation time enhances the operation of the paddle blades 42 for pushing a sheet S.

The characteristics of a sheet S includes the size of the sheet S and the printing mode used for forming an image on the sheet S. A larger sheet S will be in contact with the tray surface 32S in a larger area, which causes a higher friction between the sheet S and the tray surface 32S. The operation time determining unit 62 thus determines a longer rotation time of the rotation shaft 41 for such a large sheet S. The data on the printing mode is about whether a sheet S has undergone a single-side printing or a double side printing. In ink-jet printing, a sheet S that has undergone a double-side printing has a higher moisture content and a higher surface friction. The operation time determining unit 62 generally determines a longer rotation time of the rotation shaft 41 for a sheet S in a double-side printing than for a sheet S in a single-side printing. The operation time determining unit 62 may determine the same rotation time of the rotation shaft 41 for both sheets S in single-side printing and double-side printing. The operation time determining unit 62 retrieves the data on the characteristics of a sheet S from the main housing 11 and determines a proper rotation time. The operation time determining unit 62 may also refer to the data on a printing rate in a sheet S, which also affects the moisture content of the sheet S, to determine a proper rotation time. The operation time determining unit 62 may also refer to the data on the quality of a sheet S (for example, normal paper sheets and ink-jet printing paper sheets have different surface conditions), and the printing method (for example, electrophotography and ink-jet printing provide different surface conditions of printed sheets) to determine a proper rotation time of the rotation shaft 41.

The operation time determining unit 62 can stop the rotation of the rotation shaft 41 being driven by the paddle driving motor 46 based on the detection results from the sheet-arrival detecting sensor 36. The sheet-arrival detecting sensor 36 detects the contact of the rear end SE of a sheet S with the receiving member 34 on the processing tray 32. After the sheet-arrival detecting sensor 36 has detected the arrival of the sheet 5, the paddle unit 4 does not need to draw the sheet S any more. Even within the rotation time of the rotation shaft 41, which has been determined based on the characteristics of the sheet S, the operation time determining unit 62 should preferably stop the rotation of the rotation shaft 41 as soon as the sheet-arrival detecting sensor 36 detects the arrival of the sheet S.

Alternatively (in a modified embodiment), the operation time determining unit 62 may not determine a rotation time of the rotation shaft 41 based on the characteristics of a sheet S in advance and may depend only on the detection results from the sheet-arrival detecting sensor 36 to stop the rotation of the rotation shaft 41. By using the detection results from the sheet-arrival detecting sensor 36, the operation time determining unit 62 surely leaves the paddle unit 4 to continue to draw the sheet S until the sheet S arrives at the predetermined position of the processing tray 32.

The sheet conveyance controlling unit 63 controls the conveyance driving motor 26 to control or stop the rotation of the driving roller 222 of the first take-out roller pair 22 and the driving roller 231 of the second take-out roller pair 23.

The nip release controlling unit 64 controls the nip releasing actuator 251 to release or restore the second nip area 23N at a predetermined timing. For example, when a predetermined number of sheets S is to be stapled, the nip release controlling unit 64 operates the nip releasing actuator 251 after the arrival of the first sheet S at the predetermined position on the processing tray 32. The nip releasing actuator 251 operates the nip releasing mechanism 25 to release the second nip area 23N. After the second and subsequent sheets S have arrived at the predetermined position on the processing tray 32 following the first sheet S and the all the sheets P have been stapled, the nip release controlling unit 64 restores the second nip area 23N so that the stapled bundle sheets P goes through the second nip area 23N to be ejected onto the loading tray 24.

[Operation Flow of Post-Processing Apparatus]

Figure 9:
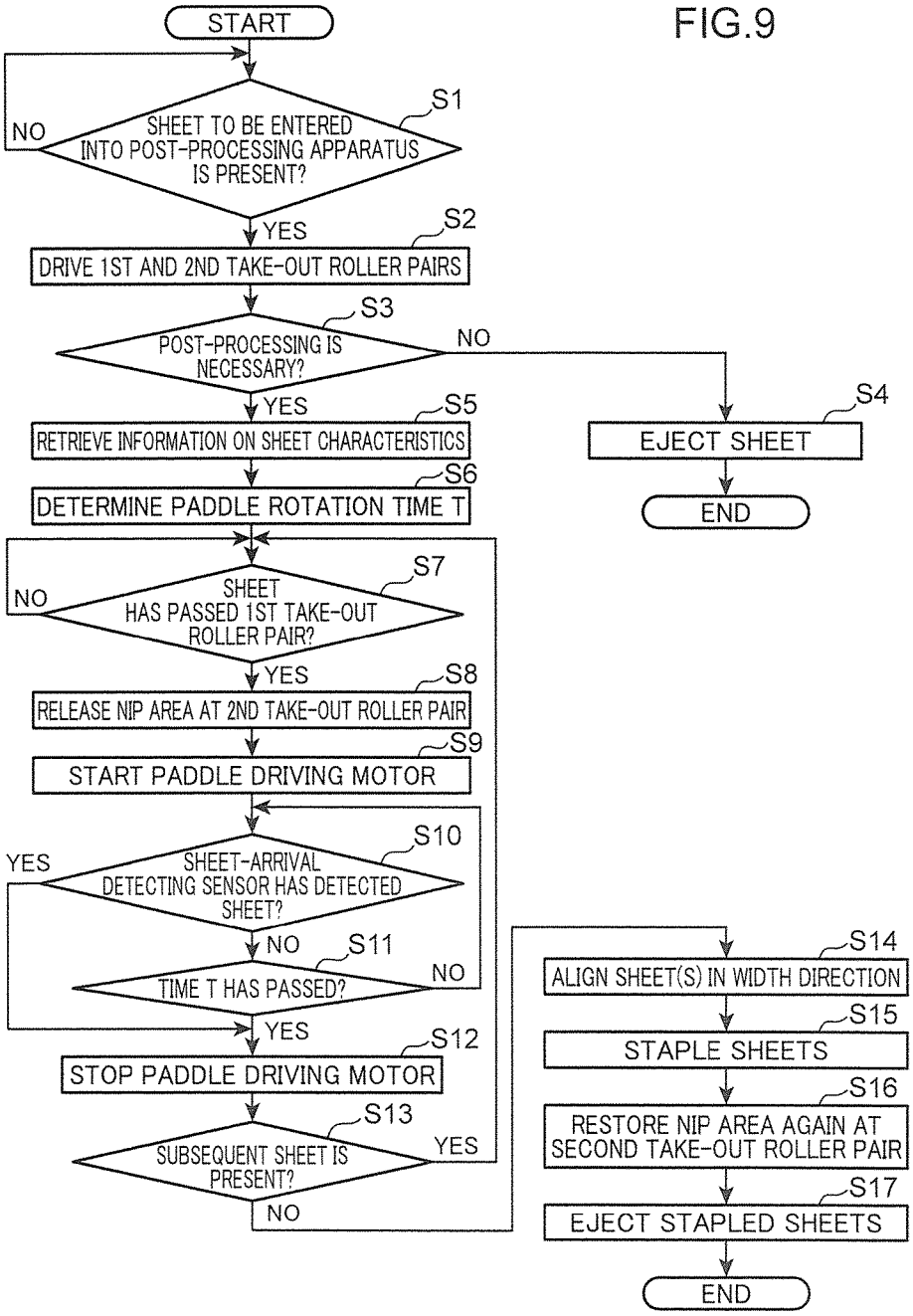
FIG. 9 is a flow chart showing a procedure of the operation of the post-processing apparatus.

With reference to the flow chart in FIG. 9, an example procedure for stapling by the post-processing apparatus 2 will now be described. The flow chart in FIG. 9 mainly describes the operation of the paddle unit 4 for drawing the sheet S and simply describes some of the operations of the sheet aligning unit 30.

The controller 6 determines whether there are instructions to enter a sheet S into the post-processing apparatus 2 for finally ejecting the sheet S outside (Step S1). If there are no instructions on the sheet ejection (NO at Step S1), the controller 6 remains on standby. If there are instructions on the sheet ejection (YES at Step S1), the sheet conveyance controlling unit 63 starts the conveyance driving motor 26 at a predetermined timing. The conveyance driving motor 26 rotates the take-in roller pair 21 to take a sheet S from the main housing 11 into the post-processing housing 12, and rotates the first and second take-out roller pairs 22 and 23 to convey the sheet S along the sheet conveying path C (Step S2).

The controller 6 then determines whether the sheet ejection instructions contain instructions on post-processing (stapling) (Step S3). If the sheet ejection instructions do not contain instructions on the post-processing (NO at Step S3), the first and second take-out roller pairs 22 and 23 continue to convey the sheet S and eject the sheet S onto the loading tray 24 (Step S4).

If the sheet ejection instructions contain instructions on the post-processing (YES at Step S3), the operation time determining unit 62 retrieves the data on characteristics of the sheet S (e.g. the size of the sheet 5) from the main housing 11 side (Step S5), and determines an operation time of the paddle unit 4, that is, a rotation time T of the rotation shaft 41 to be driven by the paddle driving motor 46 (Step S6).

The sheet conveyance controlling unit 63 then determines whether the rear end SE of the sheet S has passed the first nip area 22N made by the first take-out roller pair 22 based on the detection results from the sheet detecting sensor 35 (Step S7). If the sheet S has not yet passed the first nip area 22N (NO at Step S7), the first and second take-out roller pairs 22 and 23 continue to rotate.

If the sheet S has passed the first nip area 22N (YES at Step S7), and if the sheet S is the first sheet to be post-processed; the sheet conveyance controlling unit 63 reverses the rotation of the second take-out roller pair 23. At the same time, the paddle controlling unit 61 operates the paddle driving motor 46, which causes the push-down units 5 to push down the rear end SE of the sheet S. The reverse rotation of the second take-out roller pair 23 moves the sheet S into the processing tray 32. After that, the nip release controlling unit 64 operates the second take-out roller pair 23 to release the second nip area 23N (Step S8). The second nip area 23N remains released so that the second nip area 23N is released when the second and subsequent sheets S come.

The paddle controlling unit 61 then operates the paddle driving motor 46 to rotate the rotation shaft 41 of the paddle unit 4 (Step S9). This causes the push-down units 5 to push down the rear end SE of the sheet S. As a result, the sheet S falls onto the processing tray 32. The paddle blades 42 of the paddle unit 4 then push the sheet S to draw the sheet S. After the push-down by the push-down units 5, the rotation shaft 41 may be stopped temporarily so that the pair of the width-direction aligning cursors 33 can correct the skew of the sheet S. After that, the rotation shaft 41 may start its rotation again so that the paddle unit 4 starts to draw the sheet S.

The operation time determining unit 62 then determines whether the sheet-arrival detecting sensor 36 has detected the sheet S, that is, the arrival of the rear end SE of the sheet S to the receiving member 34 (Step S10). If the sheet-arrival detecting sensor 36 has not detected the arrival of the sheet S (NO at Step S10), the operation time determining unit 62 determines whether the rotation time T, which had been determined at Step S6, has passed (Step S11). At Step S10, if the rotation time T has passed (YES at Step S11), the paddle controlling unit 61 stops the paddle driving motor 46 (Step S12). In step S10, if the sheet-arrival detecting sensor 36 has detected the arrival of the sheet S (YES at Step S10), the paddle controlling unit 61 stops the paddle driving motor 46 (Step S12). If the rotation time T has not passed yet (NO at Step S11), the paddle driving motor 46 is kept working. While the paddle driving motor 46 is working and the paddle unit 4 is drawing the sheet S, the push-down units 5 repeat pushing down the sheet S, which corrects the curl of the sheet S Once the paddle driving motor 46 is stopped, it is determined whether all the sheets S to be post-processed are placed on the processing tray 32, that is, whether there is any subsequent sheet S to be placed on the processing tray 32 (Step S13). If there is still a subsequent sheet S (YES at Step S13), the driving roller 222 is driven and the procedure returns to Step S7 and continues.

If there is no subsequent sheet S (NO at Step S13), the pair of the width-direction aligning cursors 33 starts its operation and aligns the sheets P properly in the width direction on the processing tray 32 (Step S14). In the case that the working range of the push-down units 5 does not overlap the working range of the width-direction aligning cursors 33, the width-direction aligning cursors 33 may work during the operation for drawing the sheet S. Alternatively, the width-direction aligning cursors 33 may work every time one sheet S is drawn on the processing tray 32.

The controller 6 then operates the stapler 31 to staple the bundle of the sheets S piled up properly (Step S15). After the stapling, the nip release controlling unit 64 restores the second nip area 23N (Step S16). The sheet conveyance controlling unit 63 operates the driving roller 231 of the second take-out roller pair 23 to eject the stapled sheets S onto the loading tray 24 (Step S17).

As described above, in the paddle unit 4 of the post-processing apparatus 2 of the present embodiment, only the tip part 431 of the high-friction elastic sheet 43 comes into contact with a sheet S and the reinforcing sheet 44 does not come into contact with the sheet S. The tip part 431, which is free from the restriction by the reinforcing sheet 44, of the elastic sheet 43 can be in contact with the sheet S in a large area. The intermediate part 432, which is reinforced by the reinforcing sheet 44, of the elastic sheet 43 ensures the strength necessary for working as the paddle blade 42. The paddle unit 4 thus can push the sheet S with a greater force to draw the sheet S to the predetermined position on the processing sheet tray 32 more effectively.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A post-processing apparatus, comprising:

a loading tray for receiving a sheet having been conveyed in a predetermined conveying direction;

a post-processing unit including a processing tray for receiving a sheet to be post-processed, the processing tray being disposed upstream of the loading tray in the conveying direction, and a post-processing device for performing predetermined post-processing on the sheet disposed at a predetermined position on the processing tray, the post-processing unit ejecting the post-processed sheets onto the loading tray; and a drawing paddle for sending the sheet conveyed toward the loading tray in a direction opposite to the conveying direction to draw the sheet into the predetermined position on the processing tray, the drawing paddle including a paddle rotation shaft disposed above the processing tray with a predetermined distance from the processing tray, and a paddle blade fixed to the paddle rotation shaft, the paddle blade being a laminated body including an elastic sheet having a high-friction surface and configured to be in contact with the sheet to be post-processed, and a reinforcing sheet reinforcing the elastic sheet, the elastic sheet having a first length longer than the predetermined distance in a direction orthogonal to the paddle rotation shaft and the reinforcing sheet has a second length shorter than the predetermined distance in the direction orthogonal to the paddle rotation shaft;

a driving source for rotating and driving the paddle rotation shaft;

a controller for controlling the driving source; and a sensor for detecting arrival of the sheet to be post-processed at the predetermined position on the processing tray, wherein the sheet coming into contact with the paddle blade is drawn by the rotation of the paddle rotation shaft, and the controller stops the driving source from rotating the paddle rotation shaft based on detection results from the sensor while drawing the sheet into the processing tray.

2. The post-processing apparatus according to claim 1, wherein the elastic sheet includes a first part to be in contact with the sheet to be post-processed and a second part laminated with the reinforcing sheet, the first part bends while being in contact with the sheet to be post-processed, and the reinforcing sheet has flexibility to allow the second part to bend following the bending of the first part.

3. The post-processing apparatus according to claim 1, wherein a plurality of the paddle blades are fixed to the paddle rotation shaft such that the paddle blades are separated from each other in an axial direction of the paddle rotation shaft.

4. The post-processing apparatus according to claim 1, wherein the controller determines a rotation time of the paddle rotation shaft to be driven by the driving source based on characteristics of the sheet to be post-processed, for drawing the sheet into the processing tray.

* * * * *